US007698789B2

(12) United States Patent
Cserpes

(10) Patent No.: US 7,698,789 B2
(45) Date of Patent: Apr. 20, 2010

(54) APPARATUS FOR HOLDING TOWEL

(76) Inventor: Frank Cserpes, 672 Boundary Blvd., Rotonda West, FL (US) 33947

( * ) Notice: Subject to any disclaimer, the term of this patent is extended or adjusted under 35 U.S.C. 154(b) by 0 days.

(21) Appl. No.: 12/181,836

(22) Filed: Jul. 29, 2008

(65) Prior Publication Data

US 2010/0024175 A1 Feb. 4, 2010

(51) Int. Cl.
*A44B 17/00* (2006.01)

(52) U.S. Cl. ..... 24/303

(58) Field of Classification Search ..... 24/3.11, 24/3.12, 3.6, 303; 224/250, 901, 253, 226, 224/183; 335/302, 306
See application file for complete search history.

(56) References Cited

U.S. PATENT DOCUMENTS 6,334,239 B1 * 1/2002 Kraut ..... 24/3.6
2008/0134474 A1 * 6/2008 Uryasov ..... 24/303

* cited by examiner

*Primary Examiner*—James R Brittain
(74) *Attorney, Agent, or Firm*—Jerry D. Haynes; Law Offices of Jerry D. Haynes

(57) ABSTRACT

Disclosed is a towel holding apparatus for providing a ready access to a towel by a user. The towel holding apparatus includes an attachment assembly. The attachment assembly includes a clasping member capable of being detachably attached to an item of the user. Further, the attachment assembly includes a first connector detachably attached to the clasping member, and a first set of magnets removably engaged with the first connector. The towel holding apparatus further includes a holding assembly. The holding assembly includes a second set of magnets removably coupled to the first set of magnets of the attachment assembly. Further, the holding assembly includes a second connector removably engaged with the second set of magnets, and a holding member detachably attached to the second connector. The holding member is capable of removably holding the towel.

6 Claims, 2 Drawing Sheets

APPARATUS FOR HOLDING TOWEL

FIELD OF THE INVENTION

The present invention relates generally to an apparatus for removably holding towels, and thereby providing an easy access to the towels by a user.

BACKGROUND OF THE INVENTION

Towels are widely used in a variety of sports and recreational activities by users such as sportsmen, fishermen, hunters, and golfers for a variety of purposes. Such purposes may include, but are not limited to, wiping sweat of faces and/or hands of the users; and drying and/or cleaning of playing equipments, and such similar equipments or accessories that may be employed by the users. Accordingly, there is an increase in demand of having the towels readily accessible whenever needed by the users.

More particularly, the users such as the sportsmen require towels to be readily accessible at all times while playing sports. For example, in the game of golf, it is important that playing equipment, such as clubs and balls, remains dry and free from dirt for increasing the accuracy of shots taken by golfers while playing golf. Further, it is essential that the playing equipment is regularly dried to remove moisture during highly humid conditions. Furthermore, it is important that golfers' hands remain dry to enhance grip on the clubs while playing. To serve the aforementioned requirements, the golfers store the towels inside golf bags, access them when required, and subsequently use them for cleaning and drying their playing equipment and/or their hands.

However, most often than not, after using the towels, the golfers forget to replace the towels back in the golf bags. Consequently, the towels may get misplaced. Moreover, the process of accessing the towels from the golf bags is time consuming, and may cause distraction and discomfort to the golfers while playing golf. It should be understood that such problems may be faced by any of the aforementioned users who require towels while performing a particular activity. Accordingly, users, including golfers, require a holding apparatus for holding the towels, such that the holding apparatus is attached to items of the users, thereby making the towels readily accessible while performing the activity. Suitable examples of such items include, but are not limited to, belts, trousers, and other articles of clothing of the users.

Various holding apparatuses have previously been disclosed that may be employed by the users for holding towels to an item, such as a belt and/or any other article of clothing, of the users. A conventional holding apparatus includes a clasp that extends through an eyelet of a towel. Further, the clasp releasably connects with an item of a user. However, the conventional holding apparatus requires the towel to include the eyelet as a means for attaching the towel to the clasp that attaches to the item of the user. Accordingly, such a conventional holding apparatus may be capable of holding only those towels that include eyelets or such similar means of attachment.

Another conventional holding apparatus includes an upper portion that includes a means for fastening to a user's front waist area. Further, the conventional holding apparatus includes a lower portion, which has a layer of a towel of a specific shape and dimension. However, the conventional holding apparatus is capable of holding a towel of a specific shape and dimension thereby reducing flexibility of the user to choose any kind of a towel. Accordingly, such a conventional holding apparatus has a limited utility and may not be used to hold different kinds of readily available towels.

Still another conventional holding apparatus is capable of providing an easy access of the towel by a user but includes a mechanism that permanently secures the towel to the conventional holding apparatus, thereby preventing removal of the towel from the conventional holding apparatus when required for washing purposes after use.

Consequently, there is a need to develop a holding apparatus that may be employed by a user for removably holding a towel. Further, the holding apparatus should be capable of attaching to an item, such as a belt and/or any other article of clothing, of the user to provide an easy accessibility of the towel by the user. Furthermore, the holding apparatus should be easily disassembled, thereby providing a convenient way to remove the towel from the holding apparatus. Moreover, the holding apparatus should be light-weight, and easy-to-use. Additionally, the holding apparatus should be able to hold towels of any shape and size.

SUMMARY OF THE INVENTION

In view of the foregoing disadvantages inherent in the prior art, the general purpose of the present invention is to provide a holding apparatus that may be employed for removably holding towels, which includes all the advantages of the prior art, and overcomes the drawbacks inherent therein.

Accordingly, an object of the present invention is to provide a holding apparatus that is capable of removably holding a towel and attaching to an item, such as a belt and/or any other article of clothing, of a user to provide an easy accessibility of the towel by the user.

Another object of the present invention is to provide a holding apparatus that may be easily disassembled for conveniently removing a towel from the holding apparatus when required by a user.

Yet another object of the present invention is to provide a light-weight and an easy-to-use holding apparatus for removably holding a towel.

Still another object of the present invention is to provide a holding apparatus that is capable of removably holding towels of any shape and size.

In light of the above objects, the present invention discloses a towel holding apparatus for providing a ready access to a towel by a user. The towel holding apparatus includes an attachment assembly. The attachment assembly includes a clasping member capable of being detachably attached to an item of the user. Further, the attachment assembly includes a first connector detachably attached to the clasping member, and a first set of magnets removably engaged with the first connector. The holding apparatus further includes a holding assembly. The holding assembly includes a second set of magnets removably coupled to the first set of magnets of the attachment assembly. Further, the holding assembly includes a second connector removably engaged with the second set of magnets, and a holding member detachably attached to the second connector. The holding member is capable of removably holding the towel.

This together with other embodiments of the present invention, along with the various features of novelty that characterize the present invention, are pointed out with particularity in the claims annexed hereto and form a part of this disclosure. For a better understanding of the present invention, its operating advantages, and the specific objects attained by its uses, reference should be made to the accompanying drawings and the descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, in which:

Like reference numerals refer to like parts throughout the description of the drawings.

DETAILED DESCRIPTION OF THE INVENTION

The exemplary embodiments described herein detail for illustrative purposes are subject to many variations in structure and design. It should be emphasized, however, that the present invention is not limited to a particular towel holding apparatus, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The use of "including," "comprising," or "having" and variations thereof herein is meant to encompass the items listed thereafter and equivalents thereof as well as additional items. Unless limited otherwise, the terms "attached," "coupled," and "engaged," and variations thereof herein are used broadly and encompass direct and indirect attachments, couplings, and engagements. In addition, the terms "attached" and "coupled" and variations thereof are not restricted to physical or mechanical attachments or couplings.

The present invention provides a towel holding apparatus that may be employed by a user for removably holding a towel. More specifically, the present invention provides a towel holding apparatus that is capable of being detachably attached to an item such as a bag, a belt, and a trouser of the user, thereby providing an easy accessibility of the towel by the user. For the purpose of this description, the term, 'user,' as used herein, refers to a person that may use the towel holding apparatus of the present invention. Such a person may be a fisherman, a hunter, a soldier, a sportsman such as a golfer, and any other individual who may be in a need for a ready access to a towel for a specific purpose. Suitable examples of such a purpose may include, but are not limited to, wiping sweat or moisture from face and/or hands of the user; and drying and/or cleaning of playing equipment, and such similar equipment or accessories that may be employed by the user.

As used herein, the term 'item' may refer to the bag, the belt, or the trouser of the user, however, it should be understood that the term may also refer to other such articles of clothing of the user or even to accessories that are carried by the user while performing an activity such as a golf sport.

Figure 1:
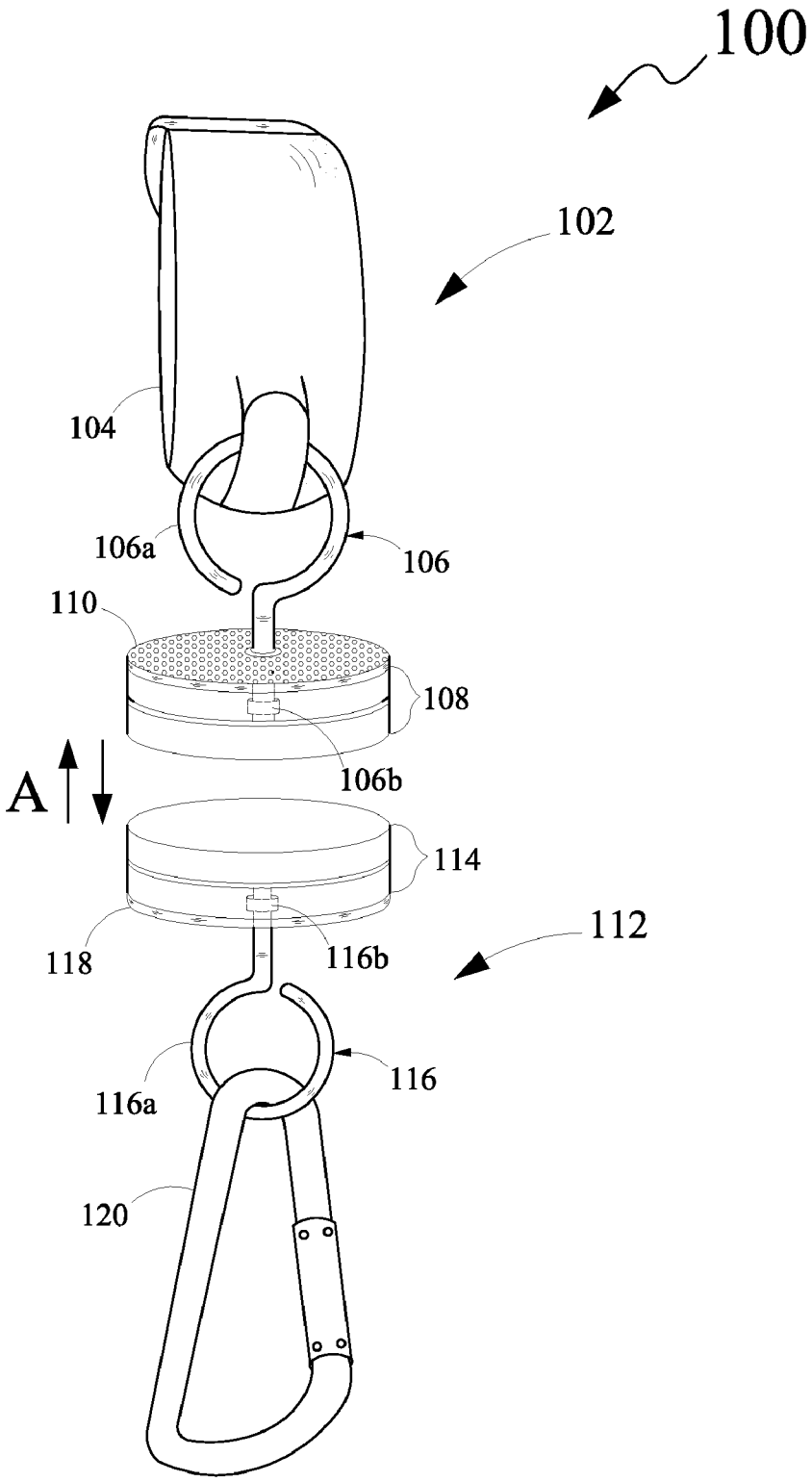
FIG. 1 depicts a perspective view of a towel holding apparatus 100, according to an exemplary embodiment of the present invention.
Figure 2:
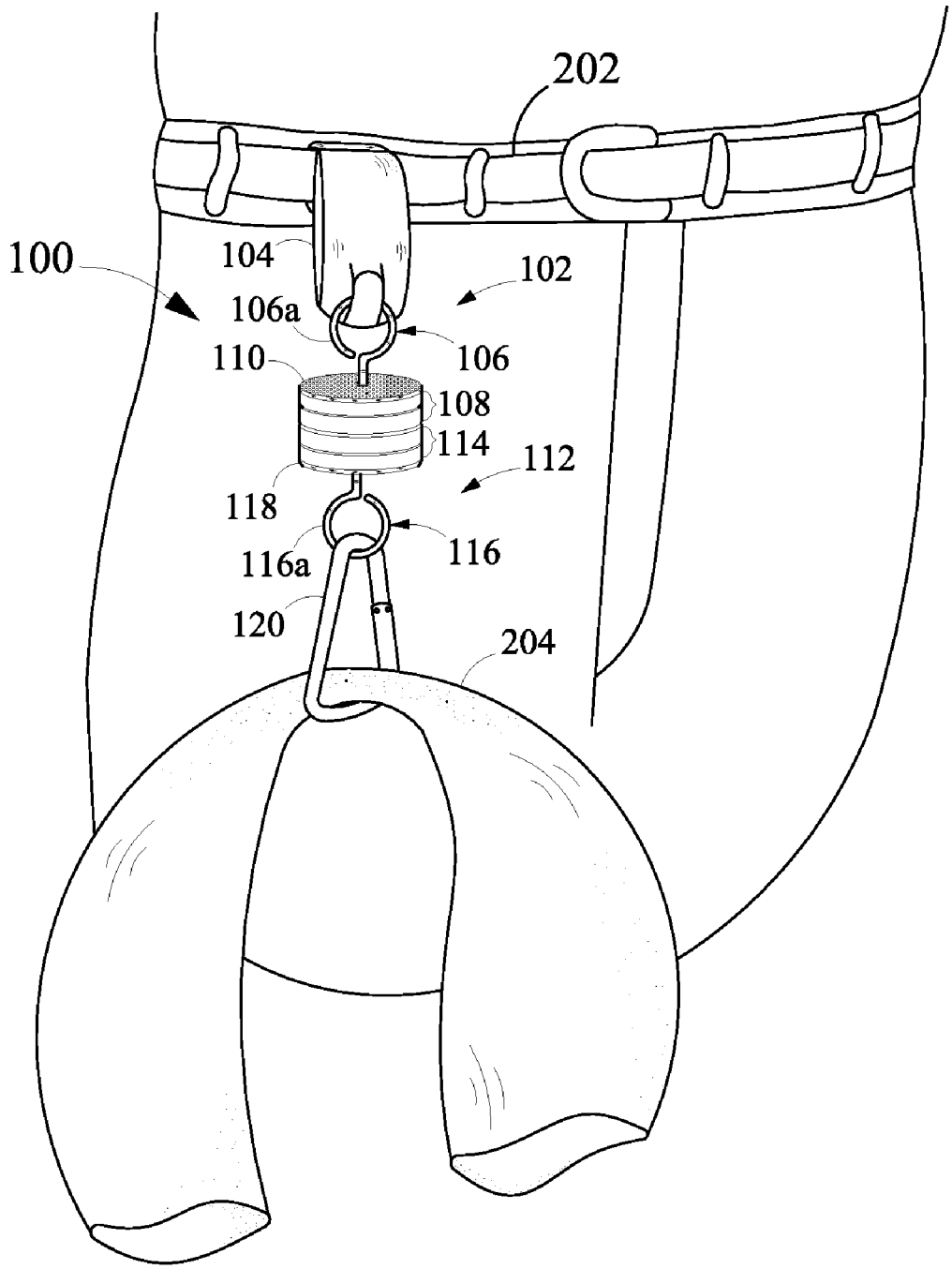
FIG. 2 depicts a perspective view of the towel holding apparatus 100 that is removably holding a towel, and is clasped to an item of a user, according to an exemplary embodiment of the present invention.

The towel holding apparatus for removably holding a towel is explained in detail in conjunction with FIG. 1 and FIG. 2.

FIG. 1 depicts a perspective view of a towel holding apparatus 100, according to an exemplary embodiment of the present invention. Further, FIG. 2 depicts a perspective view of the towel holding apparatus 100 that is removably holding a towel, and is clasped to an item of a user, according to an exemplary embodiment of the present invention.

As depicted in FIG. 1, the towel holding apparatus 100 includes an attachment assembly 102 that includes a clasping member 104. The clasping member 104 is capable of detachably attaching to an item (not shown) of a user. More specifically, the clasping member 104 provides a mechanism for detachably attaching the attachment assembly 102, and thereby the towel holding apparatus 100, to an item 202 of the user as depicted in FIG. 2.

Accordingly, suitable examples of the clasping member 104, as described above, may include a spring ring clasp, a claw clasp, a belt clasp, a belt clip, a hook, a latching pin, a safety pin, and the like. Further, it should be understood that the clasping member 104 may be made of a material, which is robust, corrosion-resistant, and light-weight. Suitable examples of such a material may include alloys such as stainless-steel, plastic, and the like. Furthermore, the clasping member 104 may be designed in any suitable shape and size that enables a convenient and a detachable attachment of the attachment assembly 102 to the item 202 of the user. In addition to the above, the clasping member 104 may be provided in a variety of colors according to a manufacturer's and/or a user's preference.

For the purpose of this description, the clasping member 104 is a belt clip, which is made of stainless-steel. Accordingly, the 'clasping member 104' may hereinafter interchangeably be referred to as 'belt clip 104'. Further, it should be understood that the belt clip 104 includes two loop-shaped portions (not shown), wherein one of the two loop-shaped portions enables the belt clip 104 to detachably attach with the item 202 of the user (as depicted in FIG. 2). Further, the belt clip 104 is of a size, which is sufficiently large to enable a detachable attachment thereof to the item 202 (as depicted in FIG. 2) of the user without causing any inconvenience thereto.

Without departing from the scope of the present invention, it should be apparent to a person skilled in the art that the term, 'item 202,' as used hereinbefore, refers to either an accessory of the user or an article of clothing of the user.

Accordingly, suitable examples of the item 202 may include a bag, a belt, a trouser, and the like. However, for the purpose of this description, the item 202 is a belt of the user as depicted in FIG. 2.

Referring to FIG. 1 and FIG. 2, the attachment assembly 102 further includes a first connector 106. The primary purpose of the first connector 106 is to provide a mechanism for detachably attaching the clasping member 104 thereto. Accordingly, suitable examples of such a first connector 106 may include, but are not limited to, an eye-bolt, and a hook. However, for the purpose of this description, the first connector 106 is an eye-bolt. The 'first connector 106' may hereinafter interchangeably be referred to as 'first eye-bolt 106'. Typically, the first eye-bolt 106 may include a first end portion, a center portion and a second end portion. As depicted in FIG. 1, the first eye-bolt 106 includes a loop **106*a* on the first end portion, and threads (not shown) and a nut 106*b* on the second end portion. The loop 106*a* of the first eye-bolt 106 is responsible for detachably attaching with the clasping member 104, as depicted in FIG. 1 and FIG. 2. Without departing from the scope of the present invention, the first eye-bolt 106** may be of a standard shape and size that is commercially available in the market. For the purpose of this description, the first eye-bolt 106 is a standard eye-bolt having a diameter of the loop 106*a* of about 3/16 inches.

Furthermore, the attachment assembly 102 includes a first set of magnets 108 removably engaged with the first eye-bolt 106. The term, 'first set of magnets 108,' as used herein, refers to a plurality of magnets coupled to each other while forming a magnetic pole having a specific magnetic polarity. Without departing from the scope of the present invention, it should be understood that the first set of magnets 108 may include a single magnet. The first set of magnets 108 employed in the attachment assembly 102 may be designed to possess any shape, size, thickness, and weight. However, for the purpose of this description, the first set of magnets 108 include two circular magnets, with each of the two circular magnets having an inner diameter of about 5/16 inches and an outer diameter of about 5/4 inches. Further, the thickness of the each of the two circular magnets may be of about 6/16 inches. Additionally, the first set of magnets 108 may be specifically designed to include a specific color over an outer surface thereof depending on a manufacturer's and/or a user's preference.

More specifically, as depicted in FIG. 1, the first set of magnets 108 is removably engaged with the first eye-bolt 106 using a first washer 110, which is disposed between the first eye-bolt 106 and the first set of magnets 108. Even more specifically, the threads of the first eye-bolt 106 are embedded within a cavity (not shown) of the first washer 110. Accordingly, it should be apparent to a person skilled in the art that the removable engagement of the first eye-bolt 106 and the first washer 110 may be achieved using a thread coupling mechanism. Such a thread coupling mechanism involves positioning of the first washer 110 on the threads of the first eye-bolt 106 in order to configure the first washer 110 thereon. Subsequently, the nut 106*b* of the first eye-bolt 106 may be screwed on the threads of the first eye-bolt 106 in order to hold the first washer 110 in between the loop 106*a* and the second end portion of the first eye-bolt 106.

Further, the first washer 110 may be either attached or fixed directly to the first set of magnets 108. Preferably, the first washer 110 may be affixed to the first set of magnets 108 using glue. It should be understood that the second end portion of the first eye-bolt 106, and more specifically the nut 106*b*, may be received in a cavity (not shown) of the first set of magnets 108. Space of the cavity that is unoccupied by the second end portion and the nut 106*b* of the first eye-bolt 106 may be filled with a material such as silicon cement to achieve a stable configuration of the attachment assembly 102.

Furthermore, it should be apparent to a person skilled in the art that the first washer 110 may be designed in a specific shape and size that compliments the shape and size of the first set of magnets 108. For the purpose of this description, the first washer 110 is a fender washer, which is circular in shape with an inner diameter of about 5/16 inches and an outer diameter of about 1 1/4 inches. However, it should be understood that use of a fender washer, as described above, in this exemplary embodiment should not be considered as a limitation to the scope of the present invention.

In addition to the attachment assembly 102, the towel holding apparatus 100 includes a holding assembly 112. The holding assembly 112 includes a second set of magnets 114 capable of being removably coupled to the first set of magnets 108 as depicted by a reversible arrow 'A' in FIG. 1. As used herein, the term, 'removably coupled' signifies a magnetic coupling of the first set of magnets 108 and the second set of magnets 114. Such a magnetic coupling enables attachment of the first set of magnets 108 and the second set of magnets 114 when positioned close to each other, and detachment of the first set of magnets 108 and the second set of magnets 114 when pulled apart from each other. More specifically, the first set of magnets 108 and the second set of magnets 114 couple together by self-aligning when positioned within a distance of about 3 inches of each other. Such a removable coupling may be referred to as a two-part magnetic closure formed by the first set of magnets 108 and the second set of magnets 114.

Furthermore, it should be apparent to a person skilled in the art that the removable coupling of the first set of magnets 108 and the second set of magnets 114 provides flexibility to the user for detaching the holding assembly 112 from the attachment assembly 102. Such a detachment may be required to handle and/or store the holding assembly 112 and the attachment assembly 102 separately. For the purpose of this description, the second set of magnets 114, like the first set of magnets 108, includes two circular magnets that are coupled to each other to form a magnetic pole having a specific magnetic polarity opposite to the magnetic polarity of the first set of magnets 108. Such an opposite magnetic polarity of the second set of magnets 114 enables the removable coupling with the first set of magnets 108. Such a removable coupling of the second set of magnets 114 and the first set of magnets 108 is depicted in FIG. 2. Furthermore, each of the two circular magnets of the second set of magnets 114 may be identical in shape, size, thickness, and color to each of the two circular magnets of the first set of magnets 108.

The holding assembly 112 further includes a second connector 116. It should be understood that the second connector 116 provides a mechanism for removably engaging with the second set of magnets 114. Further, the second connector 116 may be identical to the first connector 106, as described above, in type, and shape thereof. However, the second connector 116 employed in the holding assembly 112 may be of a size, which is different from that of the first connector 106. Accordingly, for the purpose of this description, the second connector 116 is also an eye-bolt and may interchangeably be referred to as 'second eye-bolt 116'. Typically, the second eye-bolt 116 may include a first end portion, a center portion and a second end portion. As depicted in FIG. 1, the second eye-bolt 116 includes a loop 116*a* on the first end portion, and threads (not shown) and a nut 116*b* on the second end portion. The threads of the second eye-bolt 116 are responsible for removably engaging with the second set of magnets 114. Further, the second eye-bolt 116 may be a standard '8-32' eye-bolt. Such a second eye-bolt 116 may have a diameter of the loop 116*a* of about 5/32 inches.

More specifically, the aforementioned second eye-bolt 116 is removably engaged to the second set of magnets 114 by employing a second washer 118, which is disposed between the second eye-bolt 116 and the second set of magnets 114. The removable engagement of the second eye-bolt 116 and the second washer 118 may be achieved using a thread coupling mechanism. Such a thread coupling mechanism involves positioning of the second washer 118 on the threads of the second eye-bolt 116 in order to configure the second washer 118 thereon. Subsequently, the nut 116*b* of the second eye-bolt 116 may be screwed on the threads of the second eye-bolt 116 in order to hold the second washer 118 in between the loop 116*a* and the second end portion of the second eye-bolt 116. Preferably, the second washer 118 may be affixed to the second set of magnets 114 using glue. It should be understood that the second end portion of the second eye-bolt 116, and more specifically the nut 116*b*, may be received in a cavity (not shown) of the second set of magnets 114. Space of the cavity that is unoccupied by the second end portion and the nut 116*b* of the second eye-bolt 116 may be filled with a material such as silicon cement to achieve a stable configuration of the holding assembly 112.

Further, it should be understood that the second washer 118 may be identical in type, shape and size to the first washer 110. Accordingly, for the purpose of this description, the second washer 118 is a fender washer, which is circular in shape with an inner diameter of about 5/16 inches and an outer diameter of about 1¼ inches.

Furthermore, the holding assembly 112 includes a holding member 120 detachably attached to the second eye-bolt 116. More specifically, the holding member 120 is received in the loop 116*a* of the second eye-bolt 116. The holding member 120 is capable of removably holding a towel (not shown) thereto. Accordingly, suitable examples of such a holding member 120 may include, but are not limited to, a key-hook, a key-ring, a snap-hook and a snap-ring. In one embodiment of the present invention, a key-hook has been employed as the holding member 120. In another embodiment of the invention, a key-ring with an internal diameter of about 3 inches may be employed as the holding member 120. More specifically, the holding member 120, removably holding a towel 204 thereto, is depicted in FIG. 2. Even more specifically, and as depicted, the towel 204 is inserted within a loop (not shown) of the holding member 120 in order to be hung through the holding member 120.

Moreover, it should be understood that the holding member 120 may be made of a material that is robust, corrosion-resistant, and light-weight. Suitable examples of such a material may include metals, alloys such as stainless-steel, plastic, and the like. For the purpose of this description, the holding member 120 is made of a metal such as aluminum. Further, the holding member 120 may be designed in any standard or custom shape and size that can removably hold the towel 204. Furthermore, the shape and sized of the holding member 120 enables the holding member 120 to removably hold a towel of any shape and size.

It should be understood that the towel 204, as used herein, may have a standard or a custom shape and size. Accordingly, it should be understood that the towel holding apparatus 100 is designed to hold a towel having a shape and size that vary with user-to-user preference.

In addition to the forgoing description of the towel holding apparatus 100, and with respect to shapes and sizes of various components thereof, it should be understood that overall length of the towel holding apparatus 100 may be ranging from about 5½ inches to about 6 inches. Further, in one embodiment of the present invention, the overall length of the towel holding apparatus 100 removably holding a towel may be ranging from about 12 to about 16 inches. Furthermore, overall weight of the towel holding apparatus 100 may be about 4.25 ounces (oz). Moreover, the towel holding apparatus 100 may further include a label imprinted thereon for identification purposes. For example, the towel holding apparatus 100 may include a label, "Magna-Katch," imprinted on the clasping member 104 thereof.

Based on the forgoing, the present invention provides a towel holding apparatus, such as the towel holding apparatus 100 for providing a ready access to a towel removably held thereon by a user. The towel holding apparatus includes an attachment assembly and a holding assembly. A clasping member of the attachment assembly is capable of being detachably attached to an item, such as a bag, a belt, and a trouser of the user, or any other article of clothing of the user. The holding assembly includes a holding member capable of removably holding the towel. Accordingly, the towel holding apparatus provides an easy accessibility of the towel by the user. Further, shapes and sizes, and functionality of various components of the towel holding apparatus allow it to be a light-weight and an easy-to-use towel holding apparatus. Furthermore, due to an employment of a two-part magnetic closure, the towel holding apparatus may be easily disassembled into the attachment assembly and the holding assembly for conveniently removing the towel therefrom. In such a manner, the towel holding apparatus serves as an effective tool and provides a mechanism that allows the towel to be readily accessible by the user. Moreover, the towel holding apparatus is capable of removably holding towels of any shape and size.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and thereby enable others skilled in the art to best utilize the present invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A towel holding apparatus for providing a ready access to a towel by a user, the towel holding apparatus comprising:

an attachment assembly comprising, a clasping member capable of being detachably attached to an item of the user, a first connector detachably attached to the clasping member, a first set of magnets removably engaged with the first connector, and a first fender washer disposed between the first connector and the first set of magnets, the first fender washer capable of removably engaging the first set of magnets with the first connector; and a holding assembly comprising, a second set of magnets removably coupled to the first set of magnets of the attachment assembly, a second connector removably engaged with the second set of magnets, a second fender washer disposed between the second set of magnets and the second connector, the second fender washer capable of removably engaging the second connector with the second set of magnets, and a holding member detachably attached to the second connector, the holding member capable of removably holding the towel.

2. The towel holding apparatus of claim 1, wherein the clasping member is a belt clip.

3. The towel holding apparatus of claim 1, wherein the holding member is at least one of a key-hook, a key-ring, a snap-hook, and a snap-ring.

4. The towel holding apparatus of claim 1, wherein the first connector is an eye-bolt.

5. The towel holding apparatus of claim 1, wherein the second connector is an eye-bolt.

6. The towel holding apparatus of claim 1, wherein the item is at least one of a belt, a trouser, and a bag.

* * * * *